United States Patent [19]

Jones

[11] Patent Number: 5,018,360

[45] Date of Patent: May 28, 1991

[54] FROSTED SCULPTURE METHOD AND APPARATUS

[76] Inventor: Jeffrey K. Jones, 1861 SE. 148th, Portland, Oreg. 97233

[21] Appl. No.: 538,226

[22] Filed: Jun. 14, 1990

[51] Int. Cl.[5] ..... F25C 1/12

[52] U.S. Cl. ..... 62/66; 62/1; 62/340

[58] Field of Search ..... 62/1, 66, 340, 59

[56] References Cited

U.S. PATENT DOCUMENTS

| | | | |
|---|---|---|---|
| 1,713,776 | 5/1929 | Moore | 62/59 X |
| 2,419,376 | 4/1947 | Shaw | 62/340 X |
| 2,959,940 | 11/1960 | McDonald | 62/458 |
| 2,959,942 | 11/1960 | McDonald | 62/526 |
| 3,328,974 | 7/1967 | Matsushita | 62/272 X |
| 4,011,733 | 3/1977 | Kuckens et al. | 62/59 |
| 4,351,157 | 9/1982 | Zeigler | 62/340 X |
| 4,497,179 | 2/1985 | Iwans | 62/59 |

*Primary Examiner*—William E. Tapolcai, Jr.
*Attorney, Agent, or Firm*—Kolisch, Hartwell, Dickinson, McCormack & Heuser

[57] ABSTRACT

Method and apparatus for creating and maintaining frosted sculptures are described. In a preferred embodiment, the apparatus includes an armature, or a length of conduit freely formed into a desirable shape, having circulated therethrough, by reverse-sublimation means operatively coupled therewith, a freezing agent. The reverse-sublimation means preferably includes pump means, condensation means and metering means, and is capable of removing the sensible heat and the latent heat of fusion from water vapor surrounding the armature, thereby to promote growth, on the exposed surface of the armature, of a thick layer of rough-textured frost.

10 Claims, 1 Drawing Sheet

FROSTED SCULPTURE METHOD AND APPARATUS

BACKGROUND AND SUMMARY OF THE INVENTION

This invention relates generally to creating frosted sculptures or other useful objects. More particularly, it concerns forming into an armature having a desired shape a conduit through which is circulated a freezing agent, wherein the sensible heat and the latent heat of fusion of water vapor within the ambient air is removed so that the outer surface of the conduit is maintained below the freezing point of water, thereby to produce a blanket of frost on the outer surface of the armature, with the result being a fleshed-out, frosted sculpture.

Prior art "ice" decorations form a layer of ice on the outer surface of a transparent plastic "ice body" by condensing water droplets thereon to create an imitation ice ornament. Such an ornament is described in U.S. Pat. No. 3,328,974, entitled "Imitation Ice Ornament", issued July 4, 1967. Of course, such a decoration is neither a sculpture nor a frosted art object, because it depends for its shape on the formation of a plastic or other resinous casting, and because it simply condenses water vapor from the ambient air to produce water droplets on the outer surface thereof.

Other prior art, so-called "ice" sculptures depend upon the circulation of a refrigerating fluid through a helically formed evaporator coil disposed in substantial surface contact with an outer, ice-forming sleeve member, with the integrally proximate refrigerating means condensing the water vapor from the ambient air around the sculpture to form water, which in turn is frozen to form a layer of ice on the outer sleeve. Such method and apparatus are described in U.S. Pat. No. 4,351,157, entitled "Method and Apparatus for Forming Ice Sculptures or the Like", issued Sept. 28, 1982. Such method and apparatus impose a number of unrealistic and undesirable constraints, including the helically coiled forms that the sculpture must take, the outer sleeve member that must be in substantial surface contact with the helical coil and the required close physical proximity between the sculpture and the associated refrigerating means. Moreover, because they depend upon condensation of water by conventional refrigeration of a cooling fluid and then freezing of the water condensate, the few and limited iced sculptures that could be created thereby would have the appearance more of an icicle than of a frosted, free-form art object.

Accordingly, it is a principal object of the invention to provide method and apparatus for creating free-form frosted sculptures.

It is also an object of the invention to provide method and apparatus that produce visually and tactilely stimulating and aesthetically pleasing frosted art objects.

Another object of the invention is to provide such apparatus that can be created and maintained at room temperature.

Yet another important object is to provide such apparatus that is capable of relatively quiet operation.

It is another object to render such apparatus relatively maintenance free.

As used herein, "ice" will be understood to refer to a relatively dense, ordered, frozen-water structure that is generally transparent and has a smoothly textured outer surface. As used herein, "frost" will be understood to refer to a relatively light, irregular, frozen-water-and-entrapped-air, crystallized structure that is generally opaque and has a roughly textured outer surface. Finally, as used herein, "reverse sublimation" will be understood to refer to a process by which water is made to pass from a vapor phase to a solid phase substantially without passing through a liquid phase, i.e. a process whereby the liquid phase occurs, if at all, only fleetingly and/or in only a fractional volume of the water undergoing such a vapor-to-solid phase change.

The method of the invention may be performed by freely forming an armature from a length of hollow tubing into the general shape of a desired art object; substantially removing the sensible heat and the latent heat of fusion from water vapor surrounding the armature by circulating a freezing agent, e.g. ethyl glycol, brine, refrigerant, etc., through the hollow tubing; and metering the circulation of the freezing agent through the tubing to maintain the outer surface thereof at a temperature substantially below the freezing point of the water vapor, thereby to promote the growth of frost on the exposed surface of the armature. The apparatus of the invention may take the form of a free-form latticework including a length of freezing agent-containing tubing freely formed into a desirable shape having adjacent tubing segments defining therebetween gaps capable of being bridged by frost, thereby webbingly to interconnect such segments; and freezing means for promoting the growth of frost on the outer surface of the hollow tubing and within the gaps, the freezing means including heat-removing means capable of removing from water vapor surrounding the tubing sufficient heat to cause the water vapor to solidify in the form of frost.

These and other objects and advantages of the invention will become more readily apparent by reading the following description and by referring to the accompanying drawings.

DETAILED DESCRIPTION OF THE PREFERRED EMBODIMENT

Figure 1:
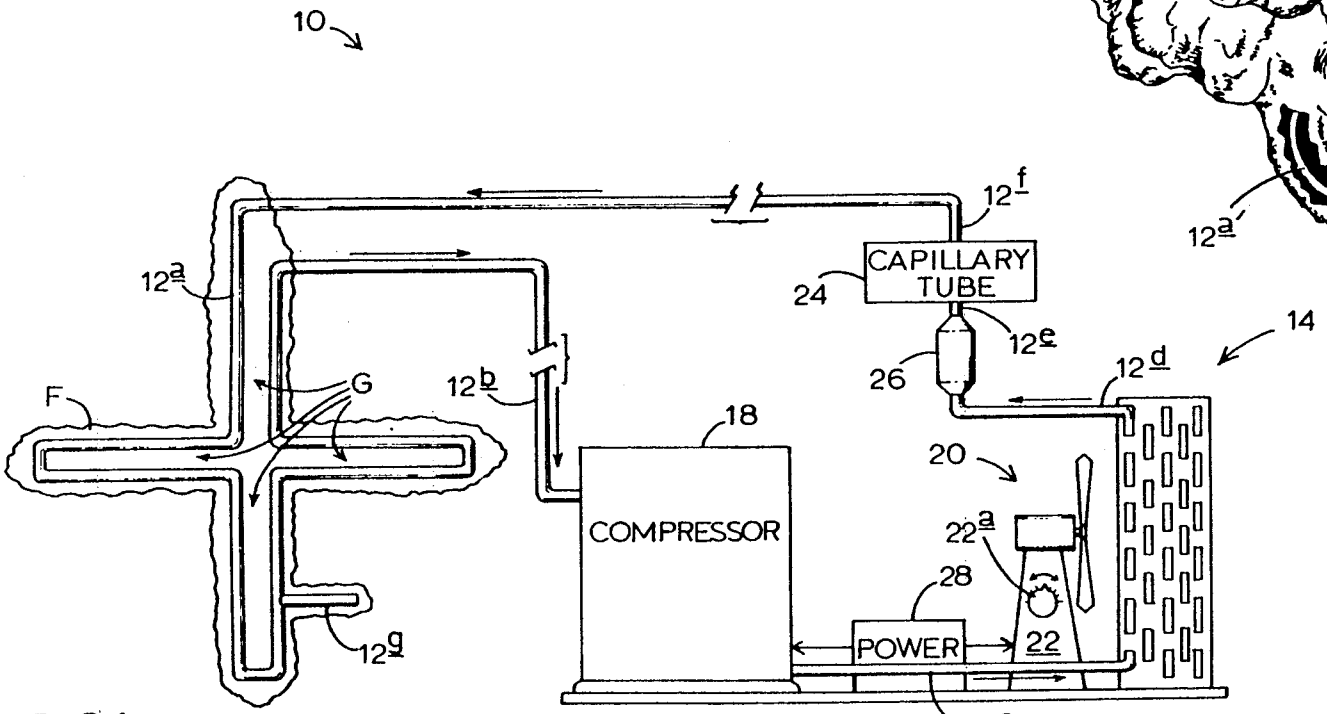
FIG. 1 is a schematic diagram of the apparatus of the invention made in accordance with its preferred embodiment.

Referring first to the schematic system diagram in FIG. 1, the apparatus of the invention for creating a frosted sculpture is indicated generally at 10. Apparatus 10 in its preferred embodiment includes a length of conduit, or shape-retentive flexible tubing, 12*a* configured to form an armature for a sculpture and heat-removing, or reverse-sublimation, means 14 operatively coupled with length of conduit 12*a* for continuously circulating a freezing agent 16, e.g. ethyl glycol or brine, therethrough. Length of conduit 12*a* freely can be formed into an armature of any desired shape, e.g. by molding or bending, such as the cross shape shown in FIG. 1. The armature desirably may be provided with gaps G between adjacent formed conduit segments, as shown.

Importantly, reverse-sublimation means 14 is capable of removing from water vapor-containing ambient air surrounding the armature the sensible heat and the latent heat of fusion of water, i.e. the amount of heat required to freeze the water vapor, substantially without producing condensate, onto the ambient air-exposed surface of the armature. Under the influence of reverse-sublimation means 14, most or all of the water vapor in the ambient air surrounding the armature passes quickly from its gas to its solid phase, and is in a liquid phase for a very brief period of time, if at all. Thus, there is negligible, if any, condensation on the outer surface of the armature and no appreciable ice formation.

In order for the apparatus of the invention to be able to freeze water vapor on contact with the tubing to form frost instead of ice, the outer surface of the tubing first should be preferably quickly brought to, and thereafter maintained at, a temperature well below the freezing point of water. The rate of heat removal required to produce such reverse-sublimation is based upon well-known formulae involving a number of factors. In addition to the relative humidity of the ambient air, these factors include the ambient temperature and the desired target temperature of the outer surface of the tubing on which frost growth is to be promoted. For example, if it is desired to operate apparatus 10 in a humid (~70% relative humidity), room temperature (25° C. or 77° F.), ambient air environment, then reverse-sublimation means 14 must be rated at approximately 212 BTU/pound (specific heat) of freezing agent in the system (based upon 1 BTU/pound to reach the freezing point of water; 144 BTU/pound to freeze the water; and 0.48 BTU/pound to deep-freeze the water). This will bring the temperature of the outer surface of copper tubing to approximately −27° C. (−16° F). When using dichlorodifluoromethane, or $CCl_2F_2$, (R-12) as freezing agent 16, a compressor having a compression ratio of approximately 8:1 is required to achieve the desired high rate of heat removal that promotes the formation of frost, rather than ice, on the outer surface of length of conduit 12*a*.

Length of conduit 12*a* and reverse-sublimation means 14 cooperate to promote the progressive accumulation or buildup on the outer surface of length of conduit 12*a*, and optionally—when the armature is formed with gaps between adjacent segments as shown in FIG. 1—within small gaps, a thick layer or blanket of frost F that fleshes out the armature to create an attractive frosted sculpture. When apparatus 10 is constructed and operated in accordance with the preferred method and apparatus of the invention described above, gaps G of up to approximately two inches effectively can be bridged by frost. Rather than being of the smooth, glassy texture of ice, blanket of frost F is of a rough texture visually and tactilely resembling that of snow.

In the preferred embodiment of the invention, reverse-sublimation means 14 includes freezing agent-circulating or -pump means, or a compressor, 18 capable of producing when energized a pressure differential from its inlet to its outlet. Reverse-sublimation means 14 also includes condensation means, indicated generally at 20, which may include a fan 22 having a variable speed motor having a manually speed control 22*a*, for cooling the freezing agent and causing it to pass from a gas to a liquid state. Reverse-sublimation means 14 includes metering means, or a capillary tube, 24 for regulating the pressure of freezing agent 16 as it flows through the armature and returns to compressor 18. In the preferred embodiment, capillary tube 24 is in fluid communication with, one (inlet) end of length of conduit 12*a*, which length of conduit acts as an evaporator and forms the frosted sculpture's armature. Reverse-sublimation means 14 includes a drier/filter 26 located between condensation means 20 and capillary tube 24 to prevent moisture from reaching the armature, and to prevent particulate contamination within conduit 12 from damaging reverse-sublimation means 14. Finally, reverse-sublimation means 14 includes any suitable power source 28 for providing AC or DC power to compressor 18 and to fan 22.

Capillary tube 24 is made generally in accordance with conventional capillary tubes used in refrigeration systems. Those of skill in the art will appreciate that the inside diameter (ID) and length of capillary tube 24 substantially predetermine its effectiveness in regulating the flow of freezing agent 16 through apparatus 10, thereby to enable frost formation on length of conduit 12*a*. An exemplary embodiment of capillary tube 24 for use in apparatus 10 has an ID of approximately 0.032-inches and a length of approximately twelve feet. Capillary tube 24 may be formed, as is known, into a helical coil in order to conserve space. Of course, these design parameters are largely dependent upon the size of apparatus 10 and the relative humidity of the ambient air in which it is operated, which determine the nominal rating of compressor 18, e.g. approximately one-quarter horsepower for a medium to large sculpture. In other words, capillary tube is chosen to match the compressor rating, as is known in the refrigeration field. Those skilled in the art will appreciate that alternative metering means 24 may serve instead to produce the desired frost growth on length of conduit 12*a*, and that the invention therefore is not limited to the use of a capillary tube.

Lengths of conduit 12*a*, 12*b*, 12*c*, 12*d*, 12*e*, 12*f* sealingly interconnect the above-described components of apparatus 10, as shown, to produce a sealed, closed-loop system. Conduit lengths 12*b*, 12*f* are shown fragmentarily in FIG. 1. This is to point out an important feature of the apparatus of the invention by which reverse-sublimation means 14 can be located substantially remotely from length of conduit 12*a*. This is important in situations where it is undesirable to have the various components of the reverse-sublimation means located, for example, directly beside the frosted sculpture for aesthetic or logistic reasons. It also is important as an energy conservation measure, because remotely located reverse-sublimation means, which in operation produces some heat, will have a lesser, adverse effect on the efficiency with which the apparatus of the invention operates. Depending upon the heat-removing efficiency of the reverse-sublimation means, the length of the conduit that forms the armature, the relative humidity and temperature of the ambient air, and the extent of thermal insulation provided conduit lengths 12*b*, 12*f*, it is possible to locate the frost-covered armature, or frosted sculpture, many feet from the reverse-sublimation means operatively coupled therewith.

Importantly, it has been found preferable to configure apparatus 10 such that the greatest possible portion of length of conduit 12*a* is inclined downwardly throughout its armature-forming path from its inlet (nearer capillary tube 24) to its outlet (nearer compressor 18). This helps ensure that as much as possible of any lubricating agent that is present in freezing agent 16 is returned to compressor 18, i.e. "oil return" is ensured, rather than undesirably building up within conduit 12, especially length of conduit 12*a* thereof. In other words, the expansion means, which in the preferred embodiment of the invention is capillary tube 24, preferably is located at a high elevation relative to length of conduit 12*a*, e.g. at or near the top of the latter's highest excursion, thereby minimizing the amount of uphill travel required of freezing agent 16.

The charging of apparatus 10 with freezing agent 16 preferably is performed by the known frostline method. That method involves manually charging apparatus 10 with a volume of freezing agent 16 that is sufficient to produce frost over the substantial length of conduit 12*a*. Persons skilled in the art will appreciate that the overcharging of apparatus 10 might result in moving the frostline too far downstream along length of conduit 12*b* (in the direction of the arrow in FIG. 1) toward compressor 18, and ultimately could freeze up the compressor itself. Conversely, the undercharging of apparatus 10 might result in moving the frostline too far upstream along length of conduit 12*a* (in a direction opposite to that of the arrow in FIG. 1.) toward the inlet of length of conduit 12*a*, and the desirable growth of frost over the entire surface of the armature would be inhibited.

By charging apparatus 10 with freezing agent 16 while observing the location of the frostline relative to the outlet of length of conduit 12*a*, it is possible properly to set up apparatus 10 for optimal frost formation and desired effect. In this regard, it will be appreciated that fan motor speed control 22*a* is effective as means operatively coupled with reverse sublimation means 14 for controlling the thickness of layer of frost F. By turning up the speed of the fan motor, thereby increasing the volume of air going across the condensor per unit time, the pressure in the system of apparatus 10 on the high-pressure (upstream) side of capillary tube 24 is reduced. By the automatic metering action of capillary tub 24, the pressure in the system on the low-pressure (downstream) side thereof will lessen to compensate for the high-pressure-side pressure reduction. As a consequence of this pressure reduction, the heat-removing capacity of reverse-sublimation means 14 is lessened somewhat, thereby reverse-sublimating less water vapor. Such controlling means 22*a* thus enables the user to control the thickness of frost F essentially by controlling the efficiency with which condensation means 20 is operated. Of course, other means for controlling the thickness of such a layer of frost are possible, and are within the spirit of the invention.

Figure 2:
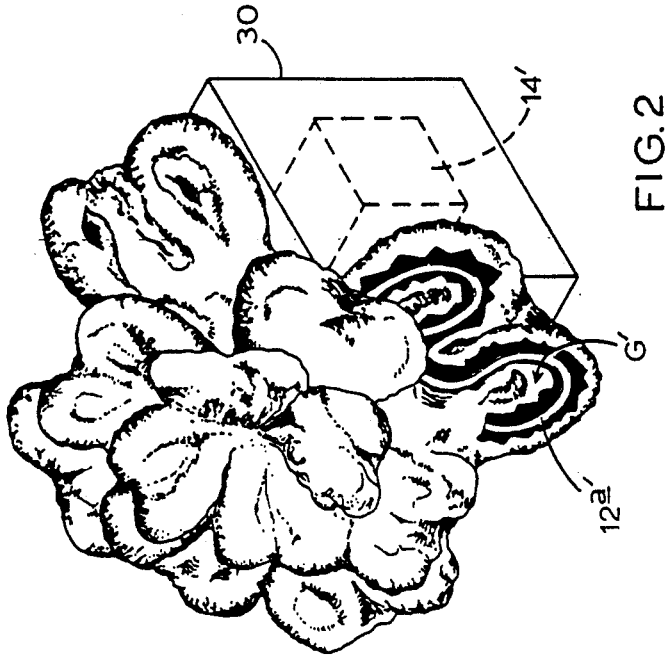
FIG. 2 is an isometric view of a frosted sculpture that is representative of the art objects made possible by the preferred method and apparatus of the invention.

Turning to FIG. 2, an illustrative frosted sculpture is shown in which the armature that is formed from length of conduit 12*a*′ resembles a flower. It will be understood that, in illustrating the alternative preferred embodiment of FIG. 2, elements that are identical to those illustrated in FIG. 1 have identical reference designators, and those elements that are similar have reference designators that are primed, e.g. cross shaped length of conduit 12*a* of FIG. 1 corresponds with flower shaped length of conduit 12*a*′ of FIG. 2. An appreciation of the free-form nature of the frosted sculptures that can be made in accordance with the invention emerges from a comparison of the three-dimensional aspect of the flower shown in FIG. 2 with the two-dimensional aspect of the cross shown in FIG. 1. It is also better appreciated, from the realistic rendering of FIG. 2 including a partial cutaway view, how the rough-textured blanket of frost builds up around the armature, and within gaps formed therein, to flesh out the sculpture. It will be appreciated by those skilled in the art that the armature may take any form, e.g. simple or intricate, impressionistic or realistic, that is desired by the artist or the person who commissioned the artwork. It also will be appreciated that the armature may assume any within a range of sizes, from miniature to the grandest of scale.

Referring still to FIG. 2, the apparatus of the invention in its preferred embodiment is described in another way. Apparatus 10 may be thought of as a frost growth-promoting, free-form skeletal object, or latticework, 10′ comprising at least one length of freezing agent-containing tubing 12*a*′ and frost growth-promoting means 14′ (illustrated schematically and in dashed lines, and constructed in accordance with reverse-sublimation, or heat-removing, means 14 shown schematically in FIG. 1) operatively coupled therewith for promoting the growth of frost on the outer surface of the tubing by circulating the freezing agent therethrough. In a preferred embodiment of latticework 10′, tubing 12*a*′ is freely formed into a desirable shape, e.g. a flower, having adjacent tubing segments defining therebetween gaps G′ capable of being bridged by frost. Frost growth-promoting means 14′ is capable of removing, from water vapor surrounding tubing 12*a*′, sufficient heat to cause such water vapor to solidify in the form of frost on the outer surface of tubing 12*a*′ substantially without passing through a liquid phase. In a preferred embodiment of latticework 10′, frost growth-promoting means 14′ promotes the growth of frost also within gaps G′. It may be seen that the promotion of the growth of frost on the outer surface of tubing 12*a*′ and within gaps G′ formed between adjacent segments thereof webbingly interconnects the segments to create a sculptured flower having fleshed-out perianth. Finally, FIG. 2 shows that frost growth-promoting means 14 may be disposed within an enclosure 30 from which tubing 12*a*′ extends, thereby to provide an attractive pedestal for the frosted sculpture.

It is appreciated that one or more lengths of conduit or tubing, within the spirit of the invention, may be formed into the desired shape, with each length having circulated therethrough a freezing agent. In such a plural conduit embodiment, many lengths of conduit might be supplied, from a common source of freezing agent, via a manifold, or via a multi-porting valve or other automatic fluid control device. Those skilled in the art will appreciate that, as described thus far in relation to the preferred embodiment of the invention described above, apparatus 10 extracts water vapor from the humid ambient air surrounding it. It also will be appreciated that preferably (to avoid ice formation) highly atomized, colored water may be sprayed onto the tubing, thereby to color enhance the frosted sculpture. Within the spirit of the invention, myriad modifications are possible.

In view of the preferred apparatus of the invention described above by reference to FIGS. 1 and 2, the preferred method of the invention now may be understood. The preferred method comprises freely forming an armature from a length of hollow tubing, e.g. length of conduit 12*a* or 12*a*′, into a shape representative of the skeleton of a desired art object; reducing the temperature of the outer surface of the tubing substantially below the freezing point of water—thereby reverse-sublimating water vapor from the air surrounding the conduit to produce frost on the outer surface thereof substantially without producing condensate, and thereby substantially removing not only the sensible heat, but also the latent heat of fusion, from water vapor surrounding the armature—by circulating, e.g. by compressor 18, through the hollow tubing a freezing agent such as freezing agent 16; and metering, e.g. by metering means 24, the circulation of the freezing agent through the tubing to maintain the outer surface of the tubing at a temperature substantially below the freezing point of the water vapor, thereby to promote the growth of frost on the exposed surface of the armature and ultimately to blanket the skeletal object with a preferably thick layer of frost.

The preferred method of the invention, for creating frosted art objects, alternatively may be described as involving the steps of forming an armature from a length of freezing agent-containing tubing, e.g. length of conduit 12*a* or 12*a'*, into the general shape of a desired art object; operatively coupling such armature with means for circulating freezing agent through the tubing, e.g. circulating means 18, wherein the freezing agent and the circulating means, when energized, are capable of maintaining the outer surface of the armature at a temperature substantially below the freezing point of water; exposing such armature to ambient air containing water vapor; and energizing such circulating means, e.g. by the application of power to circulating means 18 via a power source 28, thereby to reverse-sublimate the water vapor contained in the ambient air to produce frost on the ambient air-exposed outer surface of the formed tubing.

Alternative forms of frosted sculptures are made possible by the invention. For example, it is possible to facilitate the formation of frost within gaps between adjacent conduit segments by at least partially filling such gaps with a frost growth-promoting membrane, e.g. an expanse of aluminum foil. Also it is possible to form a frosted sculpture wherein formed lengths of hollow, freezing agent-circulating tubing such as length of conduit 12*a* have joined thereto, by sealing, thermally conductive means such as a weld joint, end-capped lengths of hollow tube (preferably less than approximately three or four inches in length), such as tube length 12*g* shown in FIG. 1. Such end-capped tube lengths are joined to mating holes formed in freezing agent-circulating length of conduit 12*a*, thereby to provide fluid communication between the conduit and the end-capped tube lengths. Surprisingly, despite that fact that there is no substantial circulation of freezing agent therethrough because there is provided no return passage, such tubes, when in substantially static fluid communication with the freezing agent being circulated through length of conduit 12*a*, nevertheless by thermal conduction and convection form a layer of frost on their exposed surfaces. This means that frosted sculptures made in accordance with the invention are not limited to forms in which a length of conduit must be looped back on itself at its extremities. Instead of, or in addition to, such loop structures, point structures thus may be formed in which, for example, a central looped length of conduit representing a tree trunk can be equipped with radially emanating, end-capped tubes of various lengths and diameters to represent branches and/or twigs. A virtually unlimited number of expressive forms are possible.

It is believed that the relative humidity of the ambient air surrounding length of conduit 12*a* is important to the operation of apparatus in forming a frosted, rather than iced, sculpture. In moderate to high relative humidity climates, e.g. where the relative humidity is greater than approximately 30%, and preferably between approximately 30% and 70%, the formation of frost is ensured when apparatus 10 is constructed in accordance with the preferred embodiment described and illustrated above. In less humid climates, it may be necessary to artificially raise the relative humidity of the ambient air around length of conduit 12*a* in order to accomplish the objects of the invention. Such easily can be accomplished by the use of conventional space humidifier equipment.

Those skilled in the art will appreciate that, incidental to its utility as an art object, apparatus 10 also can serve as a space dehumidifier. This is because, when heat-removing means 14 of apparatus 10 is in operation, moisture is removed from the ambient air to form a layer of frost on the length of conduit 12 that forms the sculpture's armature. As frost forms on the armature, the relative humidity of the air surrounding the armature is lowered accordingly. Thus, if apparatus 10 is placed on display in an enclosed room, the relative humidity of the ambient air within the room may be seen to decrease somewhat. Those of skill in the pertinent arts will appreciate that, by the use of well-known environmental control methods, it is possible to operate apparatus 10 for extended periods of time, e.g. weeks or even months, in a condition in which its armature is covered by a thick layer of frost.

Accordingly, while the invention has been shown and described with reference to a preferred method and apparatus, it will be understood by those skilled in the art that changes might be made thereto without departing from the spirit of the invention, yet while achieving many of the advantages of the invention.

It is claimed and desired to be secured by Letters Patent:

1. A method of creating a frosted art object comprising:

freely forming an armature from a length of hollow tubing into the general shape of a desired art object;

substantially removing the heat of fusion from water vapor surrounding such armature by circulating through such hollow tubing a freezing agent; and metering the circulation of the freezing agent through the tubing to maintain the outer surface thereof at a temperature substantially below the freezing point of the water vapor, thereby to promote the growth of frost on the exposed surface of such armature.

2. A frost growth-promoting, free-form latticework comprising:

at least one length of freezing agent-containing tubing freely formed into a desirable shape having adjacent tubing segments defining therebetween gaps capable of being bridged by frost thereby webbingly to interconnect such segments, and frost growth-promoting means operatively coupled with said length of tubing for promoting the growth of frost on the outer surface of said length of hollow tubing and within said gaps, said frost growth-promoting means including metering means for regulating the pressure of freezing agent as it flows through said tubing, said frost growth-promoting means removing from water vapor surrounding said tubing sufficient heat to cause such water vapor to solidify in the form of frost substantially without passing through a liquid phase.

3. A method of creating a frosted sculpture comprising:

freely forming at least one length of conduit into a desirable shape to represent a skeletal object;

circulating a freezing agent through such conduit to reduce the temperature of the outer surface thereof substantially below the freezing point of water, thereby reverse-sublimating water vapor from the air surrounding the conduit to produce frost on the outer surface thereof substantially without producing condensate; and maintaining the outer surface of said conduit below the freezing point of water, thereby to blanket such represented skeletal object with a thick layer of frost.

4. A method of creating frosted art objects comprising:

forming an armature from a length of freezing agent-containing tubing into the general shape of a desired art object;

operatively coupling such armature with means for circulating freezing agent through the tubing, wherein such freezing agent and such circulating means when energized maintain the outer surface of the armature at a temperature substantially below the freezing point of water;

exposing such armature to ambient air containing water vapor; and energizing such circulating means, thereby to reverse-sublimate the water vapor contained in the ambient air to produce frost on the ambient air-exposed outer surface of the formed tubing.

5. Apparatus for creating a frosted sculpture comprising:

a length of conduit configured to form an armature for a sculpture, with the armature having gaps between adjacent formed conduit segments, and reverse-sublimation means operatively coupled with said length, of conduit for continuously circulating a freezing agent through said length of conduit, said reverse-sublimation means maintaining the outer surface of said length of conduit at a temperature substantially below the freezing point of water and removing from water vapor-containing ambient air surrounding said length of conduit the heat of fusion of water, thereby to cause the passage of water vapor exposed to the outer surface of said length of conduit from a vapor phase to a solid phase substantially without passing through a liquid phase, said length of conduit and said reverse-sublimation means cooperating to promote the progressive buildup on the outer surface of said length of conduit and within said gaps a blanket of frost to flesh out said armature.

6. Apparatus for creating a frosted sculpture comprising:

a length of conduit formed into a desirable shape, and heat-removing means operatively coupled with said conduit for continuously circulating a freezing agent through said conduit, said heat-removing means including pump means, condensation means and metering means, said heat-removing means maintaining the outer surface of said conduit at a temperature substantially below the freezing point of water and removing from water vapor surrounding said conduit the latent heat of fusion of water, thereby to cause the passage of water vapor exposed to the outer surface of said conduit from a vapor phase to a solid phase substantially without passing through a liquid phase, said conduit and said heat-removing means cooperating to promote the accumulation on the outer surface of said conduit of a layer of frost.

7. The apparatus of claim 6, wherein said heat-removing means is substantially remote from said conduit.

8. The apparatus of claim 6, wherein said metering means includes a capillary tube.

9. The apparatus of claim 6 which further comprises means coupled with said heat-removing means for controlling the thickness of such a layer of frost.

10. The apparatus of claim 6, wherein said length of conduit includes a first and a second end operatively connected with said heat-removing means in such configuration that a substantial portion of said length of conduit is inclined downwardly from an operative connection of said first end thereof with said metering means to an operative connection of said second end thereof with said pump means.

* * * * *